US010232420B2

(12) United States Patent
Studer

(10) Patent No.: US 10,232,420 B2
(45) Date of Patent: Mar. 19, 2019

(54) METHOD FOR DETERMINING THE STAMPING QUALITY OF PROFILED BAR MATERIAL

(71) Applicant: Zumbach Electronic AG, Orpund (CH)

(72) Inventor: Urs Peter Studer, Basel (CH)

(73) Assignee: ZUMBACH ELECTRONIC AG, Orpund (CH)

( * ) Notice: Subject to any disclaimer, the term of this patent is extended or adjusted under 35 U.S.C. 154(b) by 433 days.

(21) Appl. No.: 14/890,260

(22) PCT Filed: May 9, 2014

(86) PCT No.: PCT/EP2014/059562
§ 371 (c)(1),
(2) Date: Nov. 10, 2015

(87) PCT Pub. No.: WO2014/184109
PCT Pub. Date: Nov. 20, 2014

(65) Prior Publication Data

US 2016/0082489 A1 Mar. 24, 2016

(30) Foreign Application Priority Data

May 11, 2013 (EP) ..... 13167395

(51) Int. Cl.
*B21B 38/04* (2006.01)
*B21B 1/16* (2006.01)
(Continued)

(52) U.S. Cl.
CPC ..... *B21B 38/04* (2013.01); *B21B 1/163* (2013.01); *B21B 37/16* (2013.01);
(Continued)

(58) Field of Classification Search
CPC ... B21B 2037/002; B21B 37/16; B21B 38/04; B21B 2261/08; B21B 2261/10; B21B 1/163; B21B 2001/081
See application file for complete search history.

(56) References Cited

U.S. PATENT DOCUMENTS 4,590,678 A * 5/1986 Arredondo ..... G01B 5/163 33/199 R
5,521,707 A * 5/1996 Castore ..... G01B 11/2425 356/394

(Continued)

FOREIGN PATENT DOCUMENTS

DE 2351525 A1 4/1975
EP 2468429 A1 6/2012
WO WO 2010037865 A1 * 4/2010 ..... B21B 38/04

OTHER PUBLICATIONS

Smithson R J, "Measurement and Defect Detection of Long Products." Steel Times, Fuel & Metallurgical Journals Ltd., London, GB, vol. 227, No. 11. Nov. 1, 1999, p. 408-409.

*Primary Examiner* — Teresa M Ekiert
*Assistant Examiner* — Gregory Swiatocha
(74) *Attorney, Agent, or Firm* — Bacon & Thomas, PLLC

(57) ABSTRACT

A method for determining the stamping quality of profiled bar includes steps of: a) upstream of the rolling stand performing shaping, the initial speed $V_A$ of the starting product is determined and the initial diameter $D_A$ or initial cross-sectional area $F_A$ are determined contactlessly. b) After the rolling stand, the final speed $V_E$ of the end product is measured and the diameter $D_E$ or area $F_E$ of a virtual enveloping shell for the end product is determined contactlessly. c) The diameter $D_N$ of a virtual, round end product is determined contactlessly as $D_N$=square root of $(D_A^2*V_A/V_E)$ and/or the average cross-sectional area $F_{NE}$ of the end product (2) is determined contactlessly as $F_{NE}=F_A*V_A/V_E$.

(Continued)

Figure 1:
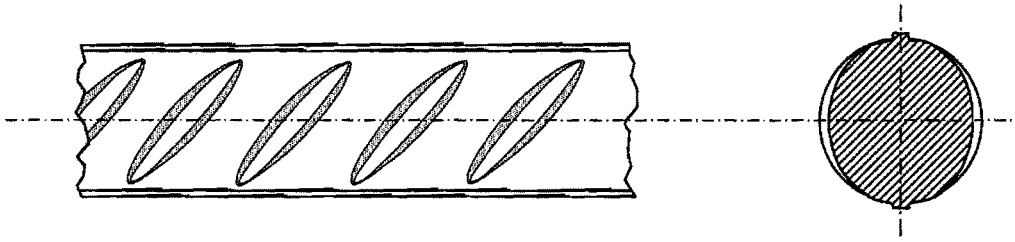

Weight per metre $G_N = G_A \times V_A / V_E$

Virtual diameter $D_N = \sqrt{D_A^2 \times V_A / V_E}$ d1) The characteristic stamping variable PKG is calculated, and the characteristic stamping variable PKG is compared with a pre-set setpoint value $PKG_{set}$. A device for carrying out the method is also provided.

24 Claims, 3 Drawing Sheets

(51) Int. Cl.
*B21B 1/08* (2006.01)
*B21B 37/00* (2006.01)
*B21B 37/16* (2006.01)

(52) U.S. Cl.
CPC ... *B21B 2001/081* (2013.01); *B21B 2037/002* (2013.01); *B21B 2261/08* (2013.01); *B21B 2261/10* (2013.01)

(56) References Cited

U.S. PATENT DOCUMENTS

| | | | | |
|---|---|---|---|---|
| 5,875,669 | A | 3/1999 | Takeda | |
| 6,055,329 | A * | 4/2000 | Mufti | G01B 9/08 250/559.12 |
| 6,549,293 | B2 * | 4/2003 | Hofman | G01B 11/105 356/602 |
| 2013/0307563 | A1 * | 11/2013 | Keintzel | B21O 51/00 324/638 |

* cited by examiner

Weight per metre $G_N = G_A \times V_A / V_E$

Virtual diameter $D_N = \sqrt{D_A^2 \times V_A / V_E}$

METHOD FOR DETERMINING THE STAMPING QUALITY OF PROFILED BAR MATERIAL

The invention relates to a method and a device for determining the stamping quality of profiled bar material, in particular of steel concrete-reinforcing bars.

The profiled bar material in question here is, in particular, ribbed round steel for concrete (also known as concrete reinforcing steel, ribbed steel or structural steel) with a diameter of about 5-50 mm. Such round steel is also referred to as a rebar (=reinforcement bar).

Depending on the country and standards, there are various types. For example, the number of rows of ribs (2, 3, 4) and the arrangement of the ribs (spacings and angles) vary. In addition, there are also "debars" (deformed bars) and screw bars (screw shaped) for concrete shutterings.

Such profiled bar material is used in particular for reinforcing concrete. The material for producing such profiled bar material is well known in the prior art.

Profiled bar material is usually produced in a rolling train from round bar material or from bar material with a constant cross section, which may for example be three-wave material or square material. Since the cross-sectional area is constant, it can be determined by customary methods. In the case of this process, a shaping process is carried out by means of stamping rollers in the last rolling stand, a process in which no material is lost. In other words, the volume or the weight of the shaped bar material is preserved.

A device suitable for this and a corresponding method are described for example in U.S. Pat. No. 5,875,669 A.

EP 2 468 429 A1 discloses a device and a method for measuring the speed of a rolled product, which is in particular a rolled strip. According to this teaching, an electromagnetic radiation in the microwave range is transmitted onto the rolled strip and the speed of the strip is determined from the reflection signal that is returned and received.

DE 23 51 525 A1 describes a method for determining the length of a bar during the rolling process. This method is used predominantly in cold and hot rolling mills.

Very large tonnages of profiled bar material, in particular concrete reinforcing steel, are produced daily. The production rate on modern lines may be in excess of 100 t/h. This may involve the end product being transported at a speed in excess of 50 m/s.

It was until now only known to carry out spot checks on the running production line. However, on account of the large amounts and the high speed, possible faults of the running line can only be detected at a very late time. There is therefore an enormous risk of producing large amounts of scrap if the end product does not meet the desired requirements. The costs are accordingly high.

The immense variety of possible profile forms and dimensions (diameters) means that a great effort is required for removing and measuring the specimens for the spot checks and for setting up the testing devices.

An important, DIN-standardized characteristic variable for concrete reinforcing steel is that known as the "related rib area" $f_R$, which is formed by the ratio of the restraining area (perpendicular to the bar axis) of the ribs to the circumferential or frictional area. These restraining areas and frictional areas ensure the securement of the reinforcing steel in the concrete within which it is encased. This "related rib area" is given in every specification of concrete reinforcing steel and, depending on the nominal diameter and quality, lies between 0.35 and 0.6.

A method for continuously detecting the stamping quality on the production line is not so far known.

The term stamping quality is used here to denote the deviation of the measured characteristic stamping variable PKG from a pre-set characteristic stamping variable, representing a setpoint value, $PKG_{set}$. The stamping quality is all the greater or all the better the smaller the deviation. This will be discussed in more detail later.

In the production process (to be more precise: the shaping process), the starting product is shaped in the last rolling stands in accordance with the form of the stamping roller in such a way that the necessary indentations and protuberances are created. A profile has the desired form when, in the shaping process, the depressions of the stamping rollers are completely filled with material, and thus the desired raised portions (for example ribs) of the profile are formed and the raised parts of the stamping rollers faithfully stamp the corresponding depressions in. This applies both to what is known as deep ribbing and to what is known as raised ribbing.

The desired form of the shaped bar material can however only be obtained if on the one hand the necessary volume or weight of material is guided to the stamping rollers and if on the other hand the infeed of the stamping rollers is set in such a way that the desired profile is obtained. Depending on the deviation from the setpoint value of the form-determining parameters, for example the volume, the weight per meter and the stamping roller infeed, typical, unwanted form defects may be obtained on the profile.

The object of the present invention is to provide a method and a device for continuously determining the stamping quality of profiled bar material in the running rolling train.

This object is achieved by the teaching of the independent claims.

In the case of the method according to the invention, in a first step a) the speed at which the starting product is fed to the shaping rolling stand is determined. This is referred to here as the initial speed $V_A$.

Moreover, unless already known, the initial diameter $D_A$ of the starting product is measured contactlessly. If the bar material has a round (to be more precise: circular disc-shaped) cross-sectional form, and is consequently a round bar, it is then quite possible to calculate the cross-sectional area, which is referred to here as the initial cross-sectional area $F_A$, from only one diameter, measured in any desired angular position.

In this simple case, it is even sufficient only to measure the diameter and to use this for the further calculations.

If the bar material has a non-round cross-sectional form, for example a square or other uniform cross-sectional form, the initial cross-sectional area $F_A$ is expediently determined by a known profile measuring device, which is explained in more detail further below. Usually, however, bar material formed in this way is shaped into round steel before the shaping process.

This alternative takes on particular significance in the case of bar material with a cross-sectional form of an orbiform. In the case of an orbiform, the diameter measured in every angular position is the same. Nevertheless, the bar material does not have a circular disc-shaped cross-sectional form and is for example three-wave or six-wave. In this case, the measurement of the initial cross-sectional area $F_A$ leads to better results than the calculation of this cross-sectional area on the basis of diameter values.

In the case of the method according to the invention, after the shaping process, and consequently after the emergence of the end product from the rolling stand in step b), on the one hand the speed $V_E$ of the end product is measured. On the other hand, in the simplest case, a single diameter $D_E$ of the end product is measured.

After the shaping, the bar material has a rod-shaped central core region, onto which the ribs are formed radially outwards in the case of a raised ribbing. In the case of a deep ribbing, this core is formed by the core region with no indentations or impressions respectively. However, both in the case of a raised ribbing and in the case of a deep ribbing, this core region cannot in practice be measured optically on the production line at the speeds prevailing there. An optical measurement on the production line therefore always detects the outer region or periphery of the measured bar material.

In the case of an optical diameter measurement, the ribs or indentations are always measured at the same time, or are included in the measured diameter value.

The measured diameter $D_E$ consequently does not represent the diameter of the core region. Rather, the diameter of the core region including the rib or indentation is detected in the measuring plane, and consequently at any point along the bar material.

The optical measurement is usually performed in a measuring plane that is arranged perpendicularly to the longitudinal axis of the bar material, and consequently that axis in which the bar material is advanced. Since the measurement is performed on the production line, and the rib structure of the bar material is usually pronounced to varying degrees, the greatest diameter measured in a time period is expediently used as the measured diameter for the calculation of the enveloping shell.

In the simplest case, the measurement of an average diameter $D_E$ in one angular position is sufficient for step b).

Assuming a circular cross section, the cross-sectional area $F_E$ of an enveloping shell, referred to here as virtual, can also be calculated without difficulty from such a diameter value. With inclusion of the length, this can be used to calculate the enveloping volume per unit of length, for example the enveloping volume per meter, which will be discussed in more detail below.

The cross-sectional area $F_E$ may also be measured, for example by a profile measurement. Methods and devices suitable for this are known and are used in particular in the measurement of an orbiform.

The enveloping shell may also be referred to as an enclosing shell. This shell lies tangentially on the bar material, at least at the point at which the diameter was measured. This shell is referred to here as virtual because, although it envelops or encloses the bar material, it does not lie against the bar material everywhere. Although the bar material is enclosed or located in the enveloping shell, it does not fill this enveloping shell because of the rib structure. In other words, the enveloping shell volume is always greater than the volume of the bar material.

If the shell cross section is circular, this enveloping shell volume is what is known as an enveloping cylinder volume. As already mentioned above, contained in this enveloping shell volume or enveloping cylinder volume is on the one hand the material volume of the end product produced and also additionally the empty volume created by the stamping (stamped impressions, spaces between ribs and other product-specific shaped parts).

In step c) of the method, in addition to the determination of $D_E$ from the initial diameter $D_A$, the diameter $D_N$ of the virtual, round end product is calculated as follows:

$$D_N = \text{square root of } (D_A^2 \times V_A/V_E)$$

$D_A$=diameter of the starting product $V_A$=measured speed of the starting product $V_E$=measured speed of the end product.

Moreover, alternatively or additionally, the average cross-sectional area $F_{NE}$ is calculated from the initial cross-sectional area $F_A$ as follows:

$$F_{NE} = F_A \times V_A/V_E$$

$F_A$=cross-sectional area of the starting product $V_A$=measured speed of the starting product $V_E$=measured speed of the end product.

The simple relationship of the cross-sectional areas is particularly worthy of consideration whenever in step a) the cross-sectional area $F_A$ of the starting product has been determined by means of a profile measuring method.

Step c) is followed by step d1) or d2).

In step d1) of the method, a characteristic variable known as the characteristic stamping variable PKG is calculated on the basis of $D_E$, $D_N$, $F_E$ and/or $F_{NE}$. The calculated value may be, for example, a percentage, a ratio or else a difference.

The PKG is preferably calculated in step d1) as the difference between $D_E$ and $D_N$ or as the ratio of $D_E$ and $D_N$ and/or as the difference between or ratio of $pi*D_E*D_E/4$ and $F_{NE}$.

Alternatively, in step d2), variables derived from the values determined and calculated in steps a), b) and c), if said derived valuables are not yet known, are used for calculating the characteristic stamping variable PKG. The derived variables are:

i) the initial volume and/or the initial weight per unit of length of the starting product (1), ii) the volume and/or the weight of the virtual enveloping shell per unit of length and iii) the volume of the end product (2) per unit of length and/or the weight of this volume of the end product (2).

With respect to step i), the following applies for example: if the starting product has a regular, ideally circular disc-shaped, cross section, the initial volume per unit of length, for example per running meter, can be calculated with the aid of the speed measurement and the simultaneous detection of the diameter, and, with the known relative density, the initial weight per unit of length, for example the weight per meter, of the starting product running into the rolling stand can be calculated. These parameters can of course also be readily calculated on the basis of the initial cross-sectional area $F_A$.

With respect to step ii), the following applies for example: the volume and/or the weight (when the relative density is known) of the virtual enveloping shell (to be more precise the weight of the volume enclosed by the virtual enveloping shell) per unit of length can be calculated from the diameter $D_E$ and/or the cross-sectional area $F_E$, with the inclusion of the length.

The cross-sectional area of an enveloping shell in the form of a round enveloping cylinder can be calculated as follows:

$$F_E = D_E^2 \times \lambda/4.$$

The stamping variable calculated according to step d1) or d2) is compared in step e) with a pre-set setpoint value or a pre-set characteristic stamping variable, representing a setpoint value, $PKG_{set}$.

This setpoint value is determined in advance, separately and outside the production line, for a bar material to be produced, and is consequently set. A number of methods are worthy of consideration for this. In the case of newly developed profiles, this characteristic variable can be simply determined from the structural design data available in the CAD. This characteristic variable can also be determined on the basis of an applicable calibration specimen, in that the weight is determined from a specimen of 1 meter in length and the material volume is calculated with the aid of the relative density. It is also possible to calculate the material volume from the displacement of a specimen in a suitable liquid, for example water. The diameter $D_E$ of such a specimen may also be measured in various known ways. Depending on what is desired and required, this can then be used for example to calculate the enveloping shell volume per unit of length and the values $F_E$, $D_N$, $F_{NE}$ and $G_N$.

If the measured PKG corresponds to the $PKG_{set}$, the rolling stand is optimally set, since the end product meets the requirements with regard to the desired form parameters.

If, on the other hand, the measured PKG deviates from the $PKG_{set}$, this information is preferably used by the plant controller of the rolling stand or the rolling plant to change the rolling parameters.

The determinations of the initial speed $V_A$ and final speed $V_E$ are preferably performed contactlessly. The contactless determinations of the initial diameter $D_A$, the initial cross-sectional area $F_A$, the diameters $D_E$ of the virtual enveloping shell and the cross-sectional area $F_E$ of the virtual enveloping shell can be determined in any known way. Preferably, all contactless determinations are performed optically.

According to a preferred embodiment, a diameter $D_A$ or $D_E$ or a number of diameters $D_A$ or $D_E$ of the starting product and of the virtual enveloping shell of the end product is/are measured.

According to a further preferred embodiment, a number of diameters at different angular positions are measured.

With particular preference, the greatest measured diameter $D_E$ of the virtual enveloping shell of the end product is used for the calculation.

Also with preference, instead of the initial diameter $D_A$ and/or the initial cross-sectional area $F_A$, the variables that can be derived from them, to be specific the initial volume or the initial weight per unit of length of the starting product, are detected, instead of the diameter $D_N$ of the virtual, round end product and the average cross-sectional area $F_{NE}$ of the bar material, the variables that can be derived from them, to be specific the volume per unit of length or the weight of this volume, are calculated and, instead of the diameter $D_E$ and/or the cross-sectional area $F_E$ of the virtual enveloping shell, the variables that can be derived from them, to be specific the volume per unit of length of this virtual volume containing the end product, are used for the calculation.

In the case of the method according to the invention, the speed and the weight per meter of the starting product and the speed and the weight per meter of the end product and also the volume of the virtual enveloping shell are preferably used for the calculation.

The invention also concerns a device for carrying out the method for determining the stamping quality of profiled bar material, in particular steel concrete reinforcing bars, which is advanced in a rolling train, wherein the method is performing according to the teaching of the claims and the description. This device of the present invention is equipped with at least one speed measuring device for the advanced starting product, with at least one speed measuring device for the end product, with at least one, in particular contactlessly operating, diameter measuring device or with at least one profile measuring device for the advanced bar material both upstream and downstream of the rolling stand for the starting product to be provided with a stamping by shaping, and with a data-processing unit for calculating the stamping quality of the profiled bar material representing the end product on the basis of the measured variables supplied by the measuring devices.

The device is preferably equipped with at least one contactlessly operating diameter measuring device or with at least one contactlessly operating profile measuring device for the advanced bar material upstream and/or downstream of the rolling stand for the starting product to be provided with a stamping by shaping.

Also with preference, one, two, three or all of the speed measuring device(s), the diameter measuring device(s) and the profile measuring device(s) is/are optical measuring devices.

For the setting and then-following control of the rolling train, the following procedure may be adopted for example.

A bar material with a known weight per meter of the starting product is fed at a known or measured speed to a rolling train.

The speed of the end product is determined and the weight per meter is calculated from it. If a specific weight per meter is intended to be achieved, the parameters of the rolling train are changed correspondingly, until the value for the weight per meter corresponds to the desired value.

Subsequently, the stamping rollers in the rolling stand are infed or opened until the achieved PKG corresponds approximately to the desired $PKG_{set}$.

Figure 2:
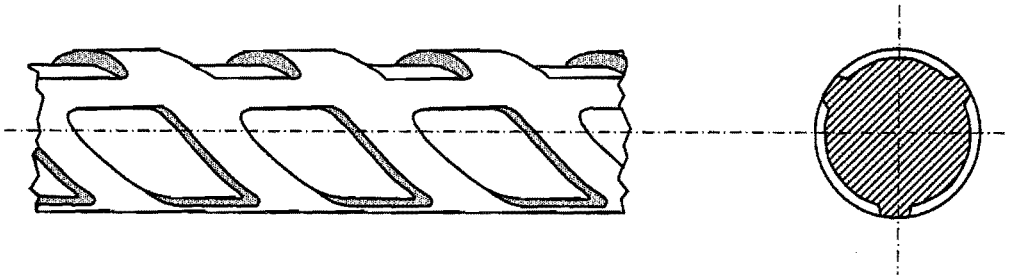
Figure 7:
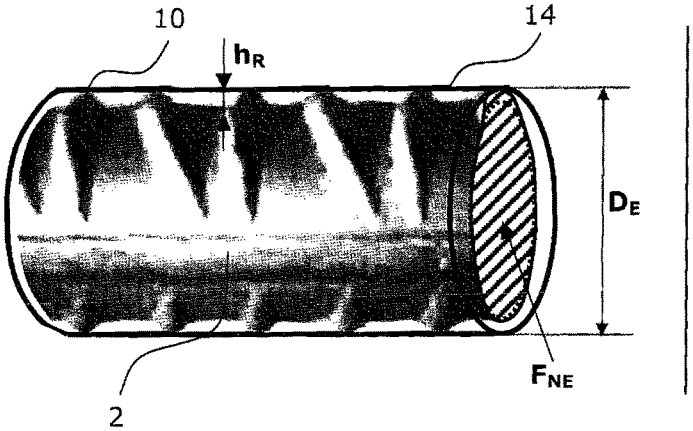
Figure 3:
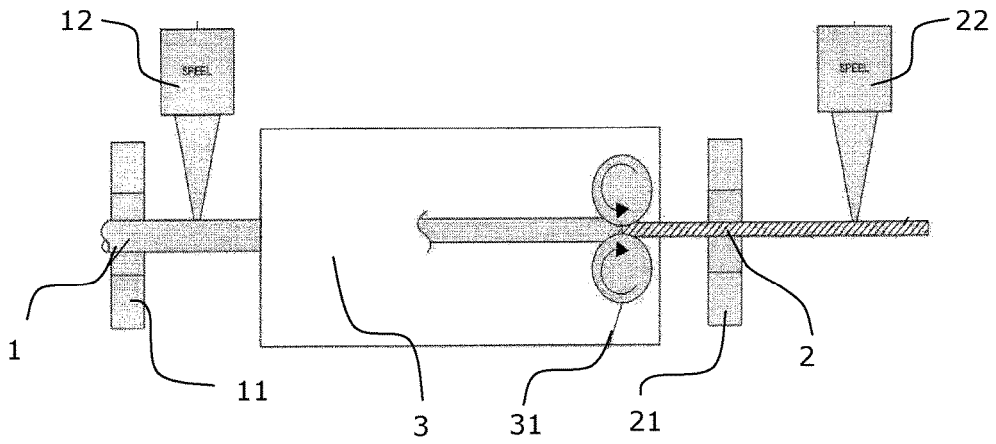
Figure 4:
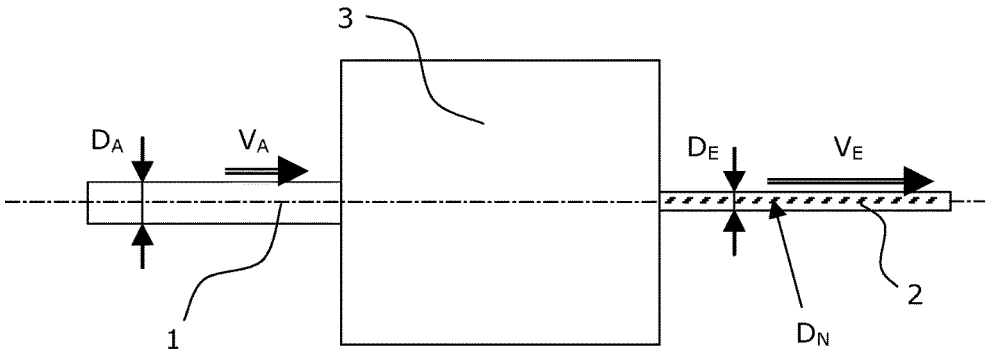
Figure 5:
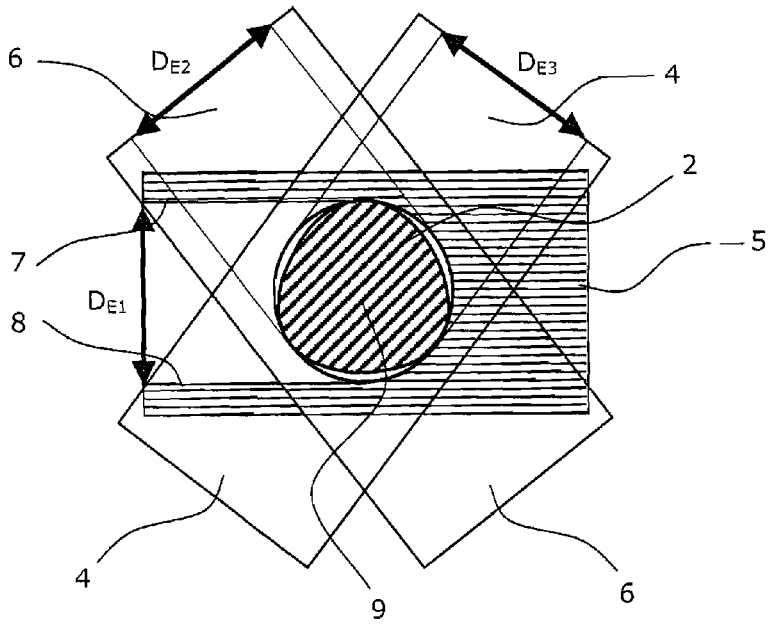
Figure 6:
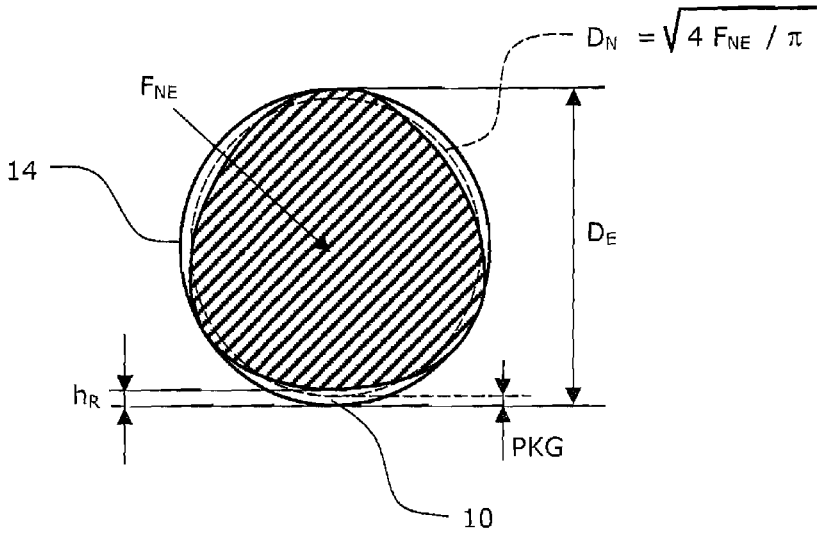

The invention is explained in more detail on the basis of the accompanying drawings, in which:

FIG. 1 shows a side view and a cross-sectional view of a rebar ribbed on two sides, with a raised ribbing, FIG. 2 shows a side view and a cross-sectional view of a rebar profiled on three sides, with a deep ribbing, FIG. 3 shows a typical rolling train in a schematic representation with the measuring devices required, FIG. 4 shows a graphic representation of the method according to the invention, FIG. 5 shows a schematic representation of a diameter measuring device, the diameter determination being based on a shadow method and a total of three diameters being determined at different angular positions of the end product, FIG. 6 shows the cross-sectional form for a three-sided rebar with raised ribbing and FIG. 7 shows a perspective representation of a rebar ribbed on two sides, with raised ribbing oriented at irregular angular positions with respect to the bar axis, and the schematically depicted enveloping shell diameter and cross section.

The profiled concrete reinforcing bars shown in FIGS. 1 and 2 are in the case of FIG. 1 a rebar with raised ribbing that is ribbed on two sides and in the case of FIG. 2 a corresponding rebar with deep ribbing that is ribbed on three sides. This profiled bar material is produced continuously and obtained after the rolling stand performing the shaping and is then cut to the desired length. All of this is known.

As can be seen from FIG. 3, the starting product 1, which is bar-shaped bar material with a round cross section, is shaped in the rolling stand 3 with the aid of the rollers 31 to form a profiled bar material or end product 2. This end product may, for example, be the end product 2 that is shown in FIG. 7.

In a manner corresponding to FIGS. 3 and 4, before entering the rolling stand 3, the speed $V_A$ of the starting product 1 fed to the rolling stand 3 is determined with the aid of a contactlessly operating speed measuring device 12.

Furthermore, the diameter $D_A$ of the starting product 1 is contactlessly detected by a diameter measuring device 11. With a known cross-sectional form, this diameter can be used to calculate the volume per running meter and, taking into account the known relative density, the weight per meter of the bar material running into the rolling stand 3.

The speed $V_E$ of the end product 2 emerging from the rolling stand 3 is likewise measured, to be precise with the aid of a speed measuring device 22.

From the known or determined volume per meter or the weight per meter of the starting product and by means of the ratio of the two speeds $V_A/V_E$, the material volume per meter or the weight per meter of the end product 2 is determined. After that, the average material cross section $F_{NE}$ is calculated from the material volume per meter, and from that the diameter $D_N$ of the virtual, round end product is determined.

Furthermore, at least one diameter $D_E$ of the end product 2 obtained is determined with the aid of a diameter measuring device 21.

From the two variables $D_E$ and $V_E$, what is known as an enveloping shell volume per meter, and in particular an enveloping cylinder volume, is calculated. Contained in this enveloping shell volume is on the one hand the material volume of the produced weight per meter of the end product 2 and also additionally the empty volume created by the stamping.

For the diameter measurement of the profiled bar material according to the invention, the measuring device that is schematically represented in FIG. 5 may be used, to be precise for the diameter measurement both of the starting product and of the end product. Such measuring devices operate contactlessly and have long been known.

In the case of the measuring device that is shown in FIG. 5, a measuring unit 4, 5, 6 is used for the diameter measurement of the end product. These measuring units 4, 5, 6 have in each case a laser scanner comprising a light-sensitive sensor and a laser. The bar material 2 is illuminated by the parallel laser beam from each of the laser scanners in such a way that the end product casts two shadow edges 7, 8 on the associated sensor. For reasons of better representation, in the case of FIG. 5 this is only shown for the laser scanner 5. The distance between the two shadow edges 7, 8 represents the diameter.

In the case of the measuring device that is shown in FIG. 5, the laser scanners 5, 6, 7 are arranged at an angle of 120° in relation to one another and determine the diameters $D_{E1}$, $D_{E2}$, $D_{E3}$ contactlessly.

Such measuring units are described for example in DE123172A, JP56-117107A and WO2008/122385.

FIG. 5 describes the situation for a three-sided rebar with a raised ribbing. The shadow edges of the three measuring units 5, 6, 7 lie in each case tangentially on one side against a rib and on the other side against a region in which there is no rib. The shaded region 9 of the end product 2 represents the cross section of the core region of the bar material without ribs, while the unshaded, crescent-shaped region lying against the end product 2 on the outside represents the region of the ribs 10.

FIG. 6 shows how a circular cross section that represents the cross section of the enveloping shell can be readily calculated from only one of the three measured diameters $D_{E1}$, $D_{E2}$, $D_{E3}$, where $F_{NE}$ represents the average cross-sectional area of the end product, from which the diameter $D_N$ of the virtual, round end product is calculated by the given formula.

The rib height $h_R$ of the ribs 10 and also the virtual enveloping shell as enveloping cylinder 14 are shown in FIG. 7.

On the basis of the embodiment given by way of example, the operating mode, actual measured values and results of the evaluation are described and logically deduced figures are given for the necessary manual or automatic control interventions in the rolling process.

Starting product, round structural steel
diameter $D_A$: 22 mm
initial cross section: 380 $mm^2$
diameter measuring device: 1-axis, laser shadow method
weight per meter $G_A$: 2.98 kg/m
initial speed $V_A$: 6.62 m/sec
speed measuring device: optical laser Doppler method End product, concrete reinforcing steel ribbed on three sides nominal weight per meter $G_E$: 0.395 kg/m, allowed tolerance −4% to +5%
diameter $D_N$ of a virtual, round end product: 8 mm
average cross section $F_{NE}$ of the end product: 50.3 $mm^2$
diameter $D_E$ of the virtual, round end product: 8.6 mm
diameter measuring device: 6-axis laser shadow method
final speed $V_E$: 50 m/sec
speed measuring device: optical laser Doppler method
$PKG_{set}$ based on diameter: 0.6 mm, allowed tolerance: +/−2% (alternatively, $PKG_{set}$ may also be based on the difference of the derived variables, cross-sectional areas, volumes per meter or weights per meter).

The diameter-based PKG is calculated in accordance with the following formula:

$$PKG_{set}=D_E-D_N$$

gives for the example explained here 8.6−8=0.6 mm
$D_E$ as the diameter of the enveloping cylinder of the end product
$D_N$ as the average diameter of the end product, calculated from the measured initial diameter $D_A$ and the speed ratio $V_A/V_E$ with the formula:

$$D_N=\text{square root of } (D_A^2\times V_A/V_E)$$

Parameters and control interventions of the shaping process
initial weight per meter $G_A$, dependent on the starting product
initial diameter $D_A$, measured
initial speed $V_A$, measured
final diameter $D_E$, measured
final speed $V_E$, measured
speed ratio $V_A/V_E$ as an automatic control intervention
infeed of the rolling stands, in particular the last stamping rollers, as a manual or automatic control intervention A basic prerequisite for the starting of a rolling line is a perfect alignment and setting of the individual rolling stands. This process is known and is not explained any further.

In a first step, the stamping rollers 31 are not closed and operation of the production line is started, until the required weight per meter is achieved at the end of the line.

After reaching the setpoint value for the weight per meter, the stamping rollers 31 are infed and adjusted in dependence on the established deviation of the determined characteristic stamping variable PKG from the required $PKG_{set}$, until the PKG value lies within the required tolerance limit.

Following that, primarily the PKG value is fixed as the quality-determining variable and then controlled. This is possible independently of the deviations of the weight per meter within the allowed large tolerance range.

The continuous checking of the characteristic stamping variable PKG according to the invention during the rolling process makes it possible to maintain the characteristic variable $f_R$, described in more detail at the beginning, as the related rib area, since the elevation of the profile by the ribs that is expressed in the PKG, measured on the basis of the enveloping diameter $D_E$, has a direct reference to the related rib area. By definition, the related rib area comprises the ratio between the rib flank area and the circumferential surface between two ribs that are adjacent in the longitudinal direction. Like the PKG, the $f_R$ value thus only varies insignificantly if the diameter changes within the practical tolerances. Put simply, under these conditions it is achieved that the stamping rollers are always completely filled, largely independently of the deviations of the weight per meter.

In practice, it is of course attempted to make the greatest possible use of the tolerances, that is to say to operate with the weight per meter of the end product as close as possible to the −4%. With the PKG control, this is possible without risk, since maintenance of the related rib area $f_R$ is thereby ensured. Conversely, even with a possible excessive weight per meter, the $f_R$ value is automatically ensured without the risk of form defects in the product due to an overfilling of the stamping rollers, since they can be manually opened by the necessary amount on the basis of a message from the evaluation unit or directly controlled by an automatic infeed, if available.

DESIGNATION OF THE REFERENCE SIGNS

Method Elements

1 starting product

11 diameter measuring device for starting product

12 speed measuring device for starting product

2 end product (profiled or ribbed concrete reinforcing steel)

21 diameter measuring device for end product

22 speed measuring device for end product

3 shaping process

31 stamping rollers

4, 5, 6 measuring units

7, 8 shadow edges

9 core region of the end product 2

10 rib

14 enveloping shell $h_R$ rib height

Parameters of the Starting Product (Localized before the Last Shaping Process)

$D_A$ initial diameter, measured $F_A$ initial cross-sectional area, calculated for example on the basis of $D_A$ $V_A$ initial speed, measured $G_A$ initial weight per unit of length, for example initial weight per meter, calculated on the basis of $V_A$ and the relative density ρ relative density Parameters of the End Product (Localized after the Shaping Process)

$D_E$ diameter of the virtual enveloping shell, measured $D_{E1}$; $D_{E2}$; $D_{E3}$ examples of diameter values in FIG. 5 for the determination of $D_E$ $F_E$ cross-sectional area of the virtual enveloping shell, calculated on the basis for example of $D_E$ or measured with the aid of a profile measuring method $V_E$ emerging speed of the end product, measured $F_{NE}$ average cross-sectional area of the end product, calculated from $F_{NE}=F_A \times V_A/V_E$ $D_N$ diameter of a virtual, round end product calculated on the basis of $F_{NE}$ $G_E$ weight per unit length, for example average weight per meter, calculated from $G_E=G_A \times V_A/V_E$ ($G_A$=initial weight per unit of length) or from $G_E=\rho \times F_{NE}$ PKG characteristic stamping variable from $PKG=D_E-D_N$ (based on the diameter values)

The invention claimed is:

1. A method for determining a stamping quality of bar material having a ribbed or recessed profile, which is advanced in a rolling train that includes a rolling stand (3) that carries out a shaping process by means of stamping rollers, the method comprising:

a) upstream of the rolling stand (3), an initial speed $V_A$ of a starting product (1) to be shaped by the rolling stand (3) is determined and, an initial diameter $D_A$ or an initial cross-sectional area $F_A$ are determined contactlessly, b) after the rolling stand (3), a final speed $V_E$ of an end product (2) is measured and a diameter $D_E$ or a cross-sectional area $F_E$ of a virtual enveloping shell for the end product (2) is/are determined contactlessly, the diameter $D_E$ or cross-sectional area $F_E$ of the virtual enveloping shell being a maximum or average diameter or cross-sectional area of the ribbed or recessed profile c) a diameter $D_N$ of a virtual, round end product is determined contactlessly as $$D_N=\text{square root of } (D_A^2 \times V_A/V_E)$$

or an average cross-sectional area $F_{NE}$ of the end product (2) is determined contactlessly as $$F_{NE}=F_A \times V_A/V_E,$$

d1) a characteristic stamping variable PKG is calculated on a basis of $D_E$ and $D_N$ or on a basis of $F_E$ and $F_{NE}$, wherein the characteristic stamping variable PKG is calculated as a difference between or a ratio of $D_E$ and $D_N$ or as the difference between, or the ratio of, $F_E$ and $F_{NE}$, or d2) values determined and calculated in steps a), b) and c) are used for calculating variables derived from them, the derived variables being:

i) an initial volume or an initial weight per unit of length of the starting product (1), ii) a volume or a weight of the virtual enveloping shell per unit of length iii) a volume of the end product (2) per unit of length or a weight of this volume of the end product (2), and iv) the characteristic stamping variable PKG is calculated as the difference between or the ratio of the volume of the virtual enveloping shell per unit of length and the volume of the end product (2) per unit of length, and/or the difference between the or the ratio of the weight of the virtual enveloping shell per unit of length and the weight of the end product (2) per unit of length, and e) the characteristic stamping variable PKG is compared with a pre-set setpoint value $PKG_{set}$, wherein $PKG_{set}$ represents a desired stamping quality.

2. The method according to claim 1, wherein the diameter $D_A$ or $D_E$ or a number of diameters $D_A$ or $D_E$ of the starting product (1) and of the virtual enveloping shell of the end product (2) is/are measured.

3. The method according to claim 2, the wherein a greatest measured diameter $D_E$ of the virtual enveloping shell of the end product (2) is used for the calculation of the characteristic stamping variable PKG.

4. The method according to claim 2, wherein the weight per meter of the starting product (1) is used for the calculation of the characteristic stamping variable PKG as the initial weight per unit of length of the starting product (1), the weight per meter of the volume of the virtual enveloping shell is used for the calculation of the characteristic stamping variable PKG as the weight per unit of length of the volume of the virtual enveloping shell and the weight per meter of the end product (2) is used for the calculation of the characteristic stamping variable PKG as the weight per unit of length of the end product (2).

5. The method according to claim 2, wherein one or more of the contactless determinations is/are performed optically.

6. The method according to claim 2, wherein the rolling train or the rolling stand (3) is controlled with the aid of the data determined in step e).

7. The method according to claim 2, wherein the diameters $D_A$ or $D_E$ at different angular positions are measured.

8. The method according to claim 7, wherein a greatest measured diameter $D_E$ of the virtual enveloping shell of the end product (2) is used for the calculation of the characteristic stamping variable PKG.

9. The method according to claim 7, wherein the weight per meter of the starting product (1) is used for the calculation of the characteristic stamping variable PKG as the initial weight per unit of length of the starting product (1), the weight per meter of the volume of the virtual enveloping shell is used for the calculation of the characteristic stamping variable PKG as the weight per unit of length of the volume of the virtual enveloping shell and the weight per meter of the end product (2) is used for the calculation of the characteristic stamping variable PKG as the weight per unit of length of the end product (2).

10. The method according to claim 7, wherein one or more of the contactless determinations is/are performed optically.

11. The method according to claim 7, wherein the rolling train or the rolling stand (3) is controlled with the aid of the data determined in step e).

12. The method according to claim 1, wherein a greatest measured diameter $D_E$ of the virtual enveloping shell of the end product (2) is used for the calculation of the characteristic stamping variable PKG.

13. The method according to claim 12, wherein the weight per meter of the starting product (1) is used for the calculation of the characteristic stamping variable PKG as the initial weight per unit of length of the starting product (1), the weight per meter of the volume of the virtual enveloping shell is used for the calculation of the characteristic stamping variable PKG as the weight per unit of length of the volume of the virtual enveloping shell and the weight per meter of the end product (2) is used for the calculation of the characteristic stamina variable PKG as the weight per unit of length of the end product (2).

14. The method according to claim 12, wherein one or more of the contactless determinations is/are performed optically.

15. The method according to claim 12, wherein the rolling train or the rolling stand (3) is controlled with the aid of the data determined in step e).

16. The method according to claim 1, wherein the weight per meter of the starting product (1) is used for the calculation of the characteristic stamping variable PKG as the initial weight per unit of length of the starting product (1), the weight per meter of the volume of the virtual enveloping shell is used for the calculation of the characteristic stamping variable PKG as the weight per unit of length of the volume of the virtual enveloping shell and the weight per meter of the end product (2) is used for the calculation of the characteristic stamping variable PKG as the weight per unit of length of the end product (2).

17. The method according to claim 16, wherein one or more of the contactless determinations is/are performed optically.

18. The method according to claim 16, wherein the rolling train or the rolling stand (3) is controlled with the aid of the data determined in step e).

19. The method according to claim 16, wherein the weight of the end product (2) is calculated as $F_{NE} \times p \times$unit of length.

20. The method according to claim 19, wherein one or more of the contactless determinations is/are performed optically.

21. The method according to claim 19, wherein the rolling train or the rolling stand (3) is controlled with the aid of the data determined in step e).

22. The method according to claim 1, wherein one or more of the contactless determinations is/are performed optically.

23. The method according to claim 22, wherein the rolling train or the rolling stand (3) is controlled with the aid of the data determined in step e).

24. The method according to claim 1, wherein the rolling train or the rolling stand (3) is controlled with the aid of data determined in step e).

* * * * *